US011619111B2

(12) United States Patent
Frost et al.

(10) Patent No.: US 11,619,111 B2
(45) Date of Patent: Apr. 4, 2023

(54) VORTEX DE-SANDING SYSTEM FOR HIGH ABRASION APPLICATIONS

(71) Applicant: ODESSA SEPARATOR, INC., Odessa, TX (US)

(72) Inventors: Cavin Bert Frost, Odessa, TX (US); Daniel L. Culbertson, Odessa, TX (US); Richard M. Burden, Midland, TX (US); Abram Rubalcado, Odessa, TX (US); Gustavo A. Gonzalez-Cabrera, Midland, TX (US)

(73) Assignee: ODESSA SEPARATOR, INC., Odessa, TX (US)

( * ) Notice: Subject to any disclaimer, the term of this patent is extended or adjusted under 35 U.S.C. 154(b) by 169 days.

(21) Appl. No.: 17/161,948

(22) Filed: Jan. 29, 2021

(65) Prior Publication Data

US 2021/0238960 A1 Aug. 5, 2021

Related U.S. Application Data

(60) Provisional application No. 62/968,320, filed on Jan. 31, 2020.

(51) Int. Cl.

| | |
|---|---|
| ***E21B 37/00*** | (2006.01) |
| ***E21B 33/12*** | (2006.01) |
| ***E21B 43/38*** | (2006.01) |

(52) U.S. Cl.

CPC ..... *E21B 37/00* (2013.01); *E21B 33/12* (2013.01); *E21B 43/38* (2013.01)

(58) Field of Classification Search

CPC ..... E21B 37/00; E21B 33/12; E21B 43/38

See application file for complete search history.

(56) References Cited

U.S. PATENT DOCUMENTS

| | | | | | |
|---|---|---|---|---|---|
| 1,601,921 | A * | 10/1926 | McCoy | E21B 43/38 | 166/105.1 |
| 5,295,537 | A * | 3/1994 | Trainer | E21B 43/38 | 166/105.3 |
| 5,516,360 | A * | 5/1996 | Normandeau | E21B 43/38 | 96/217 |
| 5,662,167 | A * | 9/1997 | Patterson | B01D 21/0003 | 166/105.1 |
| 5,810,081 | A * | 9/1998 | Cobb | E21B 43/38 | 166/105.3 |
| 6,382,317 | B1 * | 5/2002 | Cobb | E21B 43/38 | 96/216 |

(Continued)

*Primary Examiner* — Steven A MacDonald

(74) *Attorney, Agent, or Firm* — Smith IP Services, P.C.

(57) ABSTRACT

A vortex de-sanding system can include a packer having an annular seal element, a flow passage extending longitudinally through the packer, and at least one opening formed through a wall of the packer, the opening permitting fluid communication between the flow passage and an exterior of the packer, and a vortex de-sanding tool connected to the packer. The vortex de-sanding tool can include an inner production flow tube, an outer sleeve surrounding the flow tube and having at least one port formed through a wall of the outer sleeve, an abrasion resistant housing surrounding the flow tube, and a helical vane positioned in an annulus formed between the flow tube and the housing. The flow passage extends longitudinally through the flow tube, and the housing has a surface abrasion resistance greater than a surface abrasion resistance of the inner production flow tube.

21 Claims, 4 Drawing Sheets

(56) References Cited

U.S. PATENT DOCUMENTS

| | | | | |
|---|---|---|---|---|
| 8,584,744 | B2 * | 11/2013 | Soni | E21B 27/04 175/323 |
| 8,844,619 | B2 * | 9/2014 | Soni | E21B 27/00 175/323 |
| 8,881,803 | B1 | 11/2014 | Frost | |
| 9,353,590 | B2 * | 5/2016 | Soni | E21B 27/04 |
| 2002/0134554 | A1 * | 9/2002 | Schrenkel | E21B 43/38 166/372 |
| 2010/0175869 | A1 * | 7/2010 | Cobb | B01D 21/267 166/227 |
| 2012/0061073 | A1 * | 3/2012 | Soni | E21B 31/00 166/99 |
| 2013/0032352 | A1 * | 2/2013 | Raglin | E21B 43/38 166/227 |
| 2014/0014320 | A1 * | 1/2014 | Soni | E21B 31/00 166/162 |
| 2015/0000896 | A1 * | 1/2015 | Soni | E21B 31/00 166/99 |
| 2015/0144328 | A1 * | 5/2015 | Botts | E21B 43/34 166/227 |
| 2016/0251951 | A1 * | 9/2016 | Stachowiak | E21B 43/121 166/265 |
| 2016/0265332 | A1 * | 9/2016 | Saponja | E21B 43/12 |
| 2020/0392828 | A1 * | 12/2020 | Raglin | E21B 43/38 |
| 2022/0243564 | A1 * | 8/2022 | Tang | E21B 43/38 |

* cited by examiner

VORTEX DE-SANDING SYSTEM FOR HIGH ABRASION APPLICATIONS

CROSS-REFERENCE TO RELATED APPLICATION

The present application claims the benefit of the filing date of U.S. provisional application No. 62/968,320 filed on 31 Jan. 2020. The entire disclosure of the prior application is incorporated herein by this reference.

BACKGROUND

This disclosure relates generally to equipment utilized and operations performed in conjunction with a subterranean well and, in examples described below, more particularly provides a vortex de-sanding system for high abrasion applications.

If sand is produced with fluids from a well, the sand can cause many problems for equipment used with the well. For example, the sand can abrade or erode the equipment, block flow passages, cause the equipment to malfunction, etc.

Therefore, it will be readily appreciated that improvements are continually needed in the art of designing, constructing and utilizing equipment for mitigating production of sand from wells. It is among the objectives of this disclosure to provide such improvements to the art.

DETAILED DESCRIPTION

Figure 1:
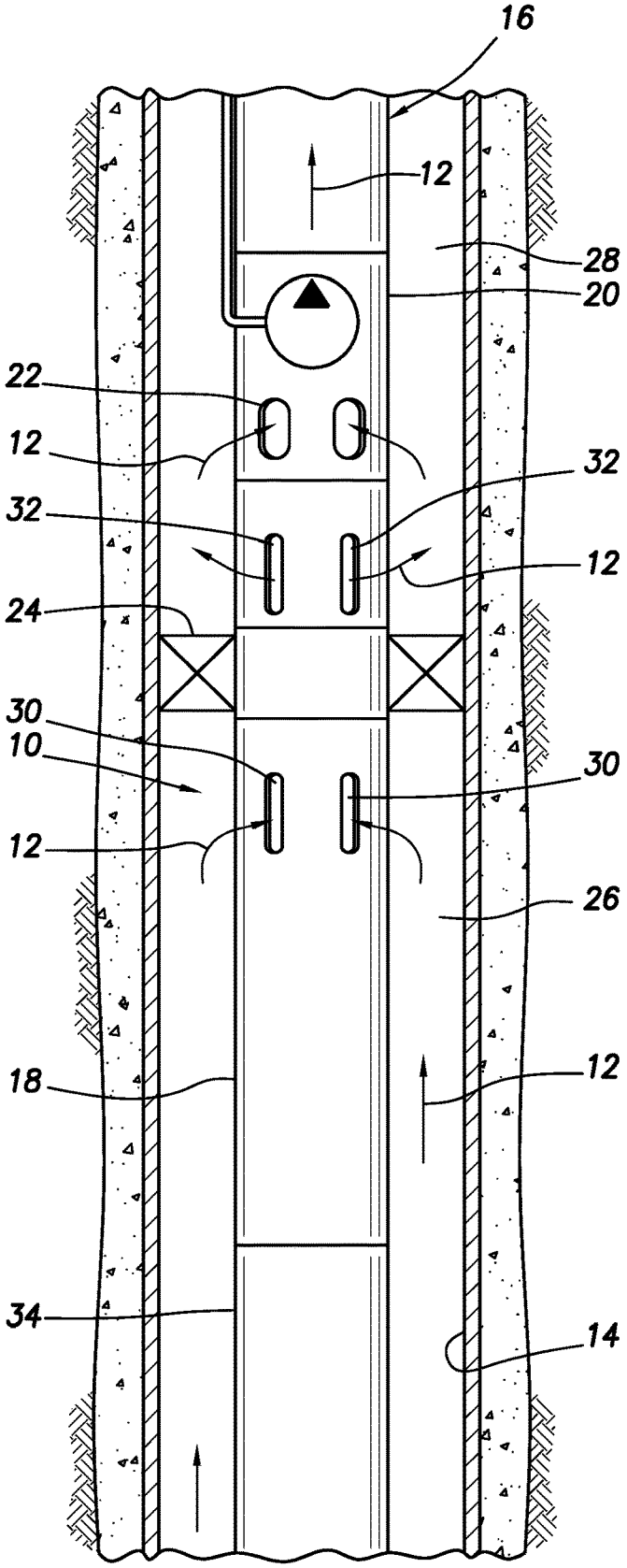
FIG. 1 is a representative partially cross-sectional view of an example of a well system and associated method which can embody principles of this disclosure.

Representatively illustrated in FIG. 1 is a vortex de-sanding system 10 and associated method which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

As depicted in FIG. 1, fluids 12 are produced from a wellbore 14 into a tubing string 16. The fluids 12 flow to surface through the tubing string 16. The vortex de-sanding system 10 includes a vortex de-sanding tool 18 configured to remove sand from the fluids 12 prior to the fluids being produced to the surface.

In the FIG. 1 example, the vortex de-sanding tool 18 is connected in the tubing string 16 upstream of an electric submersible pump 20. In this manner, the sand can be removed from the fluids 12 prior to the fluids entering an intake 22 of the pump 20, so that the sand will not impair operation of the pump. In other examples, other types of pumps may be used (such as, reciprocating rod pumps, etc.), or the tool 18 may not be connected upstream of any pump.

A packer 24 is connected in the tubing string 16 longitudinally between the tool 18 and the pump 20. The packer 24 isolates a lower annulus 26 formed between the tool 18 and the wellbore 14 from an upper annulus 28 formed between the wellbore and the remainder of the tubing string 16 above the packer.

The fluids 12 flow into the wellbore 14 from an earth formation penetrated by the wellbore. The fluids 12 flow through the lower annulus 26 and into ports 30 of the tool 18. In the tool 18, the sand is separated from the fluids 12, as described more fully below.

The fluids 12 then flow upward (as viewed in FIG. 1) through the packer 24 and exit openings 32 into the upper annulus 28. In the upper annulus 28, any gas entrained in the fluids 12 can separate and rise to the surface via the upper annulus. The remaining liquids can flow into the intake 22 of the pump 20, which will pump the liquids to the surface via the tubing string 16.

Connected below the tool 18 are one or more mostly hollow joints 34 for collection of the sand separated from the fluids 12. These sand collection joints 34 are sometimes referred to as "mud joints" by those skilled in the art.

Figure 2:
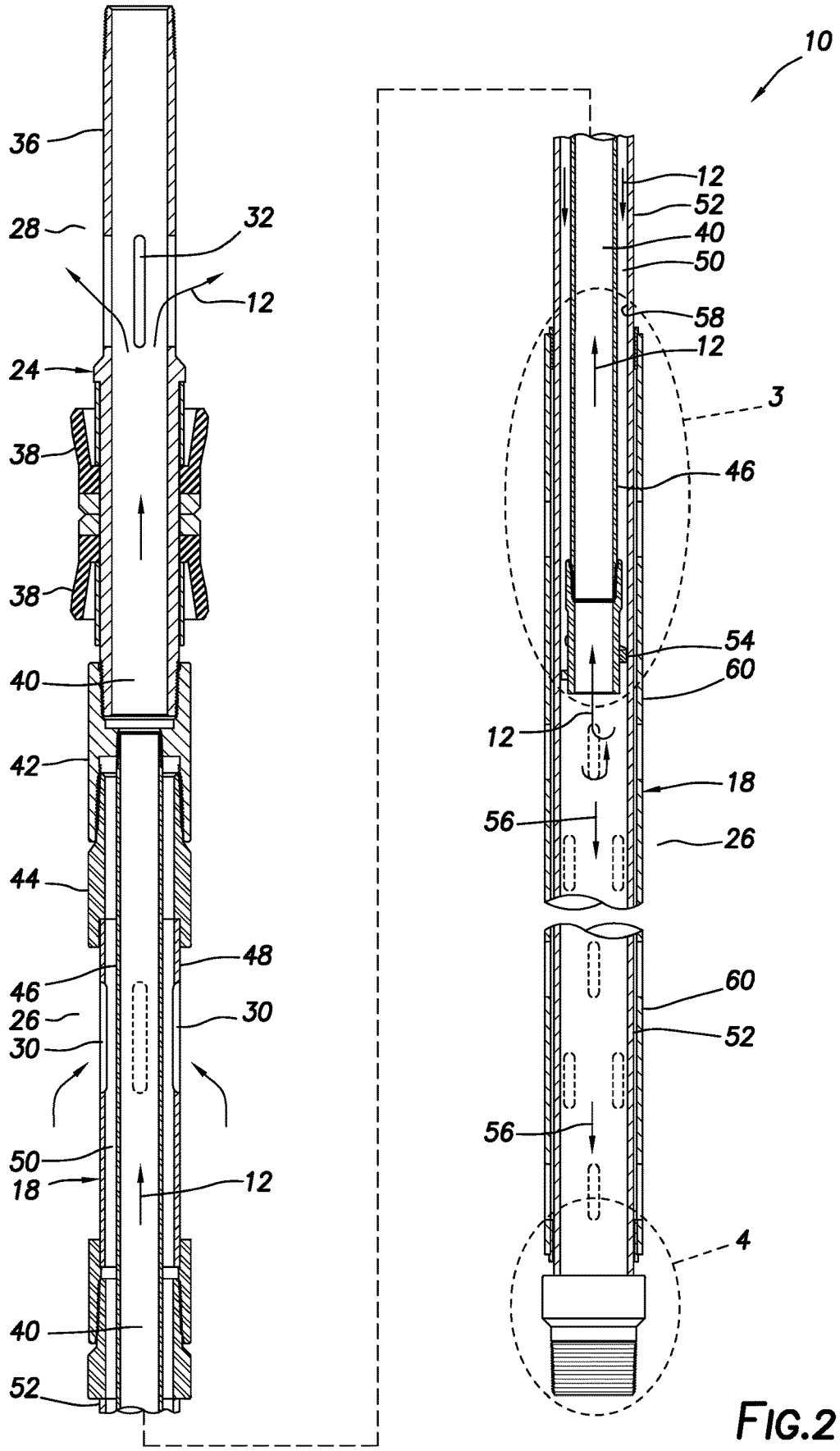
FIG. 2 is a representative partially cross-sectional view of a vortex de-sanding system that may be used with the well system and method of FIG. 1.

Referring additionally now to FIG. 2, a cross-sectional view of the vortex de-sanding tool 18 and the packer 24 is representatively illustrated. The tool 18 and packer 24 are described below as they may be used with the FIG. 1 system 10 and method, but it should be clearly understood that the tool 18 and/or packer 24 may be used with other systems and methods in keeping with the principles of this disclosure.

In the FIG. 2 example, the packer 24 includes a tubular inner mandrel 36 and annular seal elements 38 positioned on an exterior of the inner mandrel. The seal elements 38 depicted in FIG. 2 are cup-type packer elements, but other types of seal elements may be used in other examples.

The openings 32 are formed through a wall of the inner mandrel 36. The openings 32 provide for fluid communication between an inner flow passage 40 extending longitudinally through the packer 24 and the upper annulus 28 on the exterior of the packer above the seal elements 38.

As depicted in FIG. 2, the vortex de-sanding tool 18 is connected below the packer 24. A coupling 42 connects the inner mandrel 36 to an upper connector 44 of the tool 18. In addition, an inner production flow tube 46 of the tool 18 is connected in an interior of the coupling 42, so that the flow passage 40 also extends longitudinally through the inner production flow tube.

A tubular outer sleeve 48 outwardly surrounds the flow tube 46, so that an annulus 50 is formed radially between the outer sleeve and the flow tube. The ports 30 are formed through a wall of the outer sleeve 48. The ports 30 provide for fluid communication between the annulus 50 and the lower annulus 26 on an exterior of the tool 18.

A tubular abrasion resistant housing 52 is connected below the outer sleeve 48 and outwardly surrounds the flow tube 46. The annulus 50 extends radially between the flow tube 46 and the abrasion resistant housing 52. Thus, the fluids 12 can enter the ports 30 and flow downwardly through the annulus 50 to an interior of the abrasion resistant housing 52 below the flow tube 46.

In the annulus 50, the fluids 12 are caused to rotate by a helical vane 54. Centrifugal force due to the rotation of the fluids 12 in the annulus 50 causes the sand 56 to be deflected radially outward (thereby separating the sand from the fluids) and then fall downwardly through the interior of the abrasion resistant housing 52. The sand 56 accumulates in the sand collection joints 34 connected below the tool 18 (see FIG. 1).

The fluids 12 (with the sand 56 separated therefrom) can flow upwardly into the flow passage 40 in the flow tube 46. The fluids 12 can then flow into the packer 24 and exit the openings 32 into the upper annulus 28. As described above, from the upper annulus 28 the fluids 12 can enter the pump intake 22 and be produced to the surface via the tubing string 16 above the pump 20.

The abrasion resistant housing 52 is preferably made of an abrasion/erosion resistant material or is treated so that it has enhanced resistance to abrasion/erosion. For example, the abrasion resistant housing 52 can have a surface hardness that is greater than that of any other components of the tool 18. The abrasion resistant housing 52 can have a surface abrasion resistance greater than a surface abrasion resistance of the inner production flow tube 46.

In some examples, the abrasion resistant housing 52 could be treated by boronizing or specialized heat treatment to harden at least an interior surface 58 of the housing that will be impinged on by the sand 56. Alternatively, the interior surface 58 could be plated (such as, with a hard chrome material), coated or internally sleeved (such as, with a ceramic material).

Since the fluids 12 will continue to rotate some distance below the helical vane 54, the abrasion resistant housing 52 is preferably continuous (e.g., with no connections therein) for a substantial distance below the helical vane. For example, the abrasion resistant housing 52 may extend fifteen feet beyond the helical vane 54, although any distance may be used in keeping with the principles of this disclosure.

An outer housing 60 outwardly surrounds the abrasion resistant housing 52 in the FIG. 2 example. The outer housing 60 is secured to the abrasion resistant housing 52 at opposite ends of the outer housing and is used to prevent complete separation of upper and lower sections of the tool 18 in the event that the abrasion resistant housing should be cut through by the sand 56. The outer housing 60 preferably has a length that allows it to longitudinally straddle a portion of the abrasion resistant housing 52 that would be cut through by the sand due to the rotation imparted by the helical vane 54.

Figure 3:
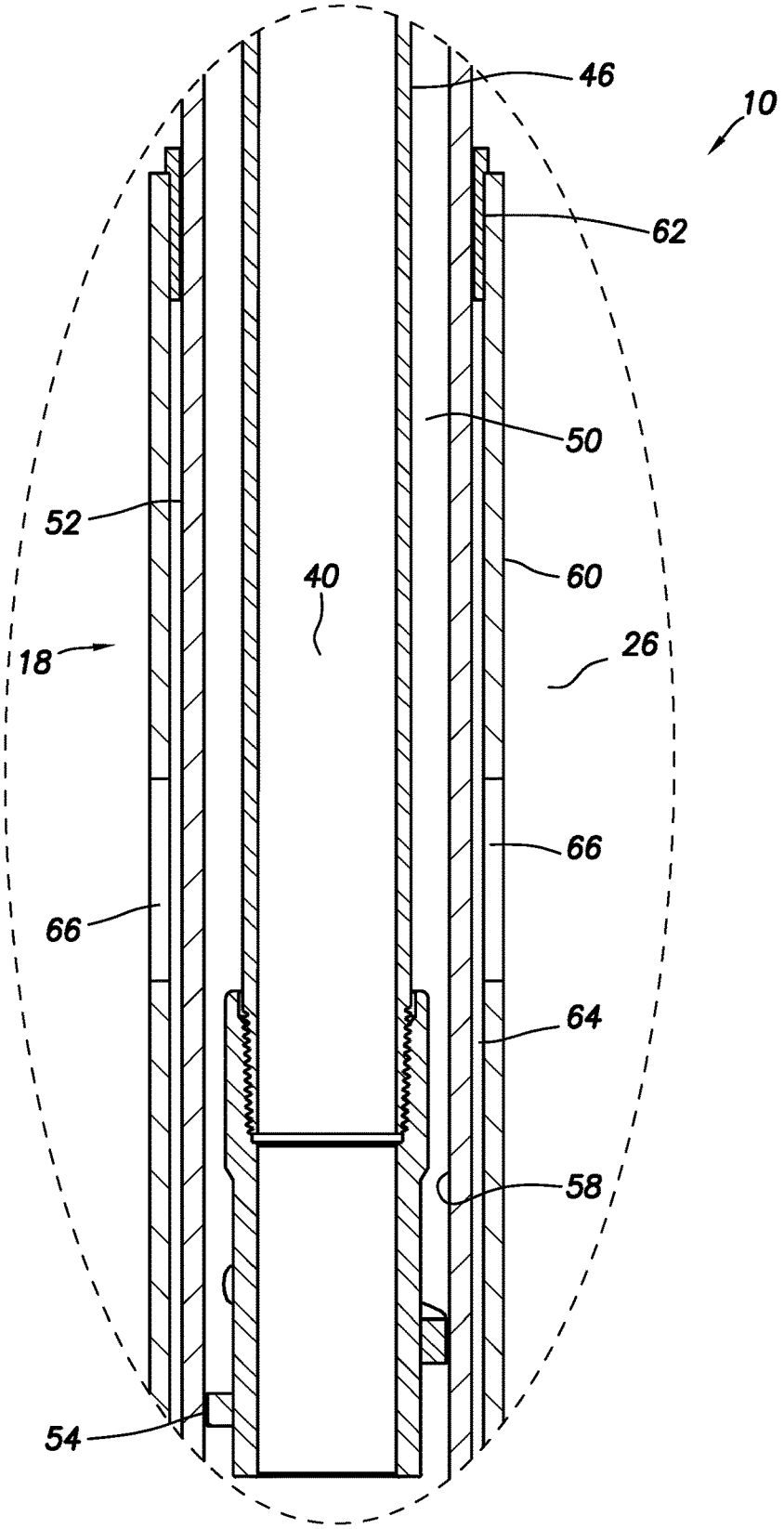
FIG. 3 is a representative cross-sectional view of a portion of the vortex de-sanding system indicated as detail 3 in FIG. 2.

Referring additionally now to FIG. 3, a cross-sectional view of a portion of the tool 18 indicated as detail 3 in FIG. 2 is representatively illustrated. In this view, the manner in which the outer housing 60 is secured to the abrasion resistant housing 52 can be more clearly seen.

An upper connector sleeve 62 is received in an upper end of the outer housing 60. In this example, the upper connector sleeve 62 is welded to the upper end of the outer housing 60 and to an exterior surface of the abrasion resistant housing 52. In other examples, the upper end of the outer housing 60 could be otherwise secured to the abrasion resistant housing 52 (such as, by threading, etc.).

Note that the upper end of the outer housing 60 is secured to the abrasion resistant housing 52 at a position longitudinally above the helical vane 54. Thus, the outer housing 60 extends longitudinally across a section of the abrasion resistant housing 52 that overlies the helical vane 54.

An annulus 64 is formed radially between the outer housing 60 and the abrasion resistant housing 52. Openings or ports 66 formed through a wall of the outer housing 60 permit fluid communication between the annulus 64 and the lower annulus 26 on the exterior of the tool 18.

If the abrasion resistant housing 52 is cut through during operation of the tool 18, the openings 66 will allow the fluids 12 to flow from the lower annulus 26 to the interior of the abrasion resistant housing 52, mostly (if not entirely) bypassing the helical vane 54. Thus, the tool 18 would not separate at the location where the abrasion resistant housing 52 is cut through. Production operations could continue, without the necessity of an expensive and time-consuming fishing operation and reinstallation of the tubing string 16, although the sand separation function of the tool 18 would be compromised or entirely eliminated.

Figure 4:
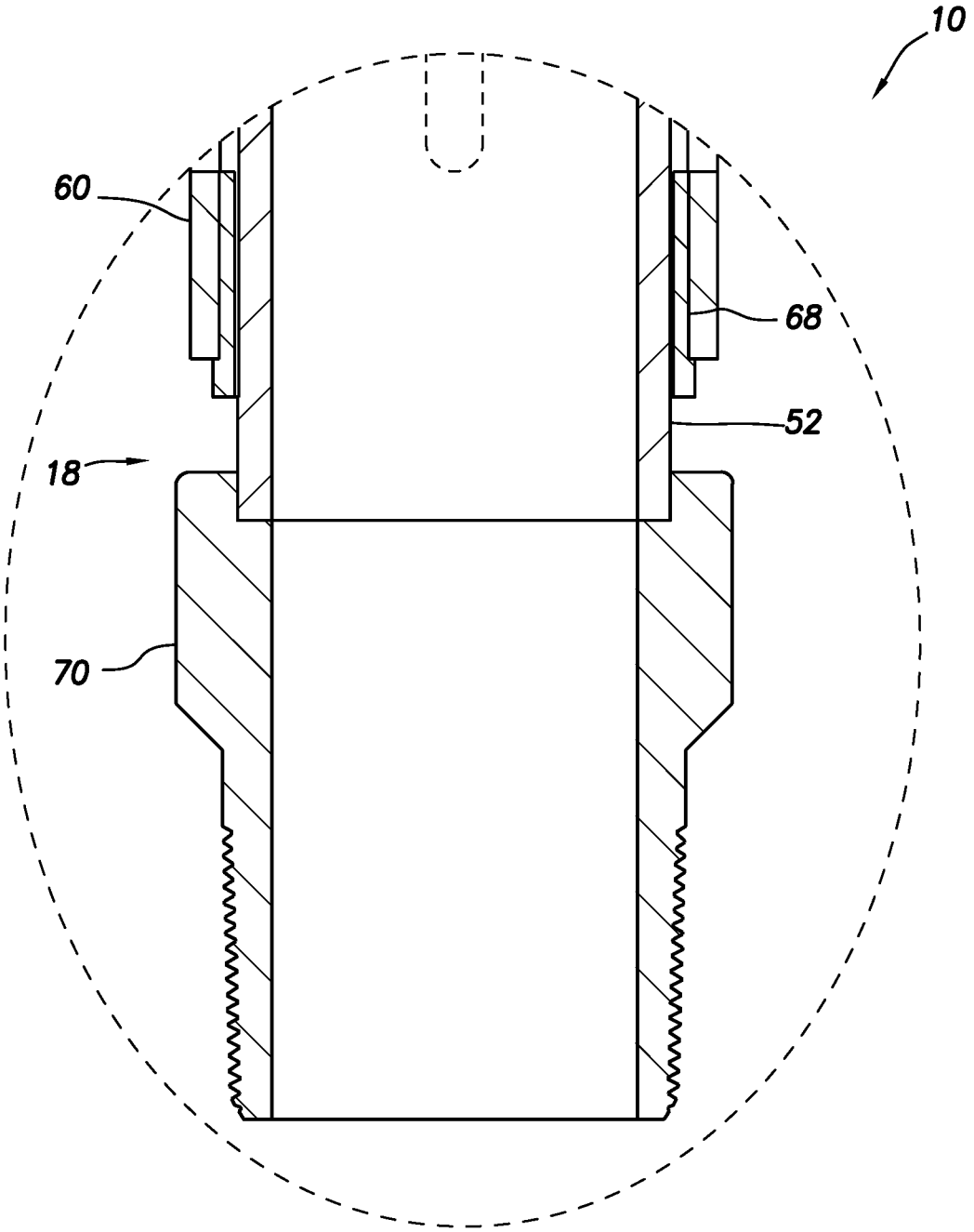
FIG. 4 is a representative cross-sectional view of a portion of the vortex de-sanding system indicated as detail 4 in FIG. 2.

Referring additionally now to FIG. 4, a cross-sectional view of a portion of the tool 18 indicated as detail 4 in FIG. 2 is representatively illustrated. In this view, it may be seen that a lower connector sleeve 68 is received in a lower end of the outer housing 60. In this example, the lower connector sleeve 68 is welded to the lower end of the outer housing 60 and to an exterior surface of the abrasion resistant housing 52. In other examples, the lower end of the outer housing 60 could be otherwise secured to the abrasion resistant housing 52 (such as, by threading, etc.).

Note that the lower end of the outer housing 60 is secured to the abrasion resistant housing 52 at a position longitudinally below the helical vane 54. Thus, the outer housing 60 extends longitudinally across a section of the abrasion resistant housing 52 that overlies the helical vane 54.

A lower connector 70 is secured to a lower end of the abrasion resistant housing 52. The lower connector 70 is configured for connecting to the sand collection joints 34 below the tool 18. For example, the connector 70 may be provided with internal or external threads for threading to an upper end of the sand collection joints 34.

It may now be fully appreciated that the above disclosure provides significant advancements to the art of designing, constructing and utilizing equipment for mitigating production of sand from wells. In examples described above, the vortex de-sanding tool 18 includes the abrasion resistant housing 52 overlying the annulus 50 in which the helical vane 54 induces rotation of the fluids 12. In addition, the outer housing 60 prevents separation of the tool 18 downhole in the event that the abrasion resistant housing 52 is cut through.

In one example, a vortex de-sanding tool 18 for use in a subterranean well can include an inner production flow tube 46, a tubular abrasion resistant housing 52, a helical vane 54 disposed in an annulus 50 formed between the inner production flow tube 46 and the abrasion resistant housing 52, and an outer housing 60 surrounding and secured to the abrasion resistant housing 52.

The outer housing 60 may be secured to the abrasion resistant housing 52 at first and second longitudinal positions (e.g., at upper and lower ends of the outer housing 60). The helical vane 54 may be positioned longitudinally between the first and second longitudinal positions. The outer housing 60 may be secured to the abrasion resistant housing 52 at first and second longitudinal positions that longitudinally straddle the helical vane 54.

The outer housing 60 may be radially spaced apart from the abrasion resistant housing 52. At least one port 66 may be formed through a wall of the outer housing 60. The port 66 may provide fluid communication between an exterior of the outer housing 60 and an annulus 64 formed between the outer housing 60 and the abrasion resistant housing 52.

A first connector sleeve 62 may be received in a first end of the outer housing 60 and a second connector sleeve 68 may be received in a second end of the outer housing 60. The first and second connector sleeves 62, 68 may be rigidly attached to each of the outer housing 60 and the abrasion resistant housing 52.

A tubular outer sleeve 48 may surround the inner production flow tube 46. The annulus 50 may be in fluid communication with an exterior of the outer sleeve 48 via at least one port 30 formed through a wall of the outer sleeve 48. A flow passage 40 extending longitudinally through the inner production flow tube 46 may be in fluid communication with an interior of the abrasion resistant housing 52.

The interior of the abrasion resistant housing 52 may be in fluid communication with an interior of at least one sand collection joint 34. The abrasion resistant housing 52 may comprise a single continuous component between the helical vane 54 and a lower connector 70 configured to connect the abrasion resistant housing 52 to the sand collection joint 34.

In another example, a vortex de-sanding system 10 for use with a subterranean well can include a packer 24 comprising an annular seal element 38, a flow passage 40 extending longitudinally through the packer 24, and at least one opening 32 formed through a wall of the packer 24, the opening 32 permitting fluid communication between the flow passage 40 and an exterior of the packer 24. The system 10 can also include a vortex de-sanding tool 18 connected to the packer 24, the vortex de-sanding tool 18 comprising an inner production flow tube 46, an outer sleeve 48 surrounding the inner production flow tube 46 and having at least one first port 30 formed through a wall of the outer sleeve 48, an abrasion resistant housing 52 surrounding the inner production flow tube 46, and a helical vane 54 positioned in a first annulus 50 formed between the inner production flow tube 46 and the abrasion resistant housing 52. The flow passage 40 extends longitudinally through the inner production flow tube 46. The abrasion resistant housing 52 has a surface abrasion resistance greater than a surface abrasion resistance of the inner production flow tube 46.

An interior surface 58 of the abrasion resistant housing 52 may have a surface treatment selected from the group consisting of boronized, hardened, plated and coated.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," "upward," "downward," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A vortex de-sanding tool for use in a subterranean well, the vortex de-sanding tool comprising:

an inner production flow tube;

a tubular abrasion resistant housing;

a helical vane disposed in an annulus formed between the inner production flow tube and the abrasion resistant housing; and an outer housing surrounding and secured to the abrasion resistant housing, in which the outer housing is secured to the abrasion resistant housing at first and second longitudinal positions via a direct connection or at most one connector, and in which the first and second longitudinal positions are located at respective opposite ends of the outer housing.

2. The vortex de-sanding tool of claim 1, in which the helical vane is positioned longitudinally between the first and second longitudinal positions.

3. The vortex de-sanding tool of claim 1, in which the first and second longitudinal positions longitudinally straddle the helical vane.

4. The vortex de-sanding tool of claim 1, in which the outer housing is radially spaced apart from the abrasion resistant housing.

5. The vortex de-sanding tool of claim 1, in which at least one port is formed through a wall of the outer housing, and the port provides fluid communication between an exterior of the outer housing and an annulus formed between the outer housing and the abrasion resistant housing.

6. The vortex de-sanding tool of claim 1, in which a first connector sleeve is received in a first end of the outer housing, a second connector sleeve is received in a second end of the outer housing, and the first and second connector sleeves are rigidly attached to each of the outer housing and the abrasion resistant housing.

7. The vortex de-sanding tool of claim 1, in which a flow passage extending longitudinally through the inner production flow tube is in fluid communication with an interior of the abrasion resistant housing.

8. The vortex de-sanding tool of claim 7, in which the interior of the abrasion resistant housing is in fluid communication with an interior of at least one sand collection joint.

9. The vortex de-sanding tool of claim 8, in which the abrasion resistant housing comprises a single continuous component between the helical vane and a lower connector configured to connect the abrasion resistant housing to the sand collection joint.

10. A vortex de-sanding tool for use in a subterranean well, the vortex de-sanding tool comprising:

an inner production flow tube;

a tubular abrasion resistant housing;

a helical vane disposed in an annulus formed between the inner production flow tube and the abrasion resistant housing; and an outer housing surrounding and secured to the abrasion resistant housing, in which a tubular outer sleeve surrounds the inner production flow tube, and the annulus is in fluid communication with an exterior of the outer sleeve via at least one port formed through a wall of the outer sleeve.

11. A vortex de-sanding system for use with a subterranean well, the system comprising:

a packer comprising an annular seal element, a flow passage extending longitudinally through the packer, and at least one opening formed through a wall of the packer, the opening permitting fluid communication between the flow passage and an exterior of the packer; and a vortex de-sanding tool connected to the packer, the vortex de-sanding tool comprising an inner production flow tube, an outer sleeve surrounding the inner production flow tube and having at least one first port formed through a wall of the outer sleeve, an abrasion resistant housing surrounding the inner production flow tube, an outer housing surrounding and secured to the abrasion resistant housing, and a helical vane positioned in a first annulus formed between the inner production flow tube and the abrasion resistant housing, in which the flow passage extends longitudinally through the inner production flow tube, in which the abrasion resistant housing has a surface abrasion resistance greater than a surface abrasion resistance of the inner production flow tube, in which the outer housing is secured to the abrasion resistant housing at first and second longitudinal positions via a direct connection or at most one connector, and in which the first and second longitudinal positions are located at respective opposite ends of the outer housing.

12. The system of claim 11, in which an interior surface of the abrasion resistant housing has a surface treatment selected from the group consisting of boronized, hardened, plated and coated.

13. The system of claim 11, in which the first annulus is in fluid communication with an exterior of the outer sleeve via the at least one first port formed through the wall of the outer sleeve.

14. The system of claim 11, in which the flow passage is in fluid communication with an interior of the abrasion resistant housing.

15. The system of claim 14, in which the interior of the abrasion resistant housing is in fluid communication with an interior of at least one sand collection joint.

16. The vortex de-sanding tool of claim 15, in which the abrasion resistant housing comprises a single continuous component between the helical vane and a lower connector configured to connect the abrasion resistant housing to the sand collection joint.

17. The system of claim 11, in which the helical vane is positioned longitudinally between the first and second longitudinal positions.

18. The system of claim 11, in which the first and second longitudinal positions longitudinally straddle the helical vane.

19. The system of claim 11, in which the outer housing is radially spaced apart from the abrasion resistant housing.

20. The system of claim 11, in which a first connector sleeve is received in a first end of the outer housing, a second connector sleeve is received in a second end of the outer housing, and the first and second connector sleeves are rigidly attached to each of the outer housing and the abrasion resistant housing.

21. A vortex de-sanding system for use with a subterranean well, the system comprising:

a packer comprising an annular seal element, a flow passage extending longitudinally through the packer, and at least one opening formed through a wall of the packer, the opening permitting fluid communication between the flow passage and an exterior of the packer; and a vortex de-sanding tool connected to the packer, the vortex de-sanding tool comprising an inner production flow tube, an outer sleeve surrounding the inner production flow tube and having at least one first port formed through a wall of the outer sleeve, an abrasion resistant housing surrounding the inner production flow tube, an outer housing surrounding and secured to the abrasion resistant housing, and a helical vane positioned in a first annulus formed between the inner production flow tube and the abrasion resistant housing, in which the flow passage extends longitudinally through the inner production flow tube, in which the abrasion resistant housing has a surface abrasion resistance greater than a surface abrasion resistance of the inner production flow tube, and in which at least one second port is formed through a wall of the outer housing, and the second port provides fluid communication between an exterior of the outer housing and a second annulus formed between the outer housing and the abrasion resistant housing.

* * * * *